US010113842B2

(12) United States Patent
Andrzejak

(10) Patent No.: US 10,113,842 B2
(45) Date of Patent: Oct. 30, 2018

(54) UTILIZATION OF SPHEROIDIZED TUNGSTEN IN SHAPED CHARGE SYSTEMS

(75) Inventor: Timothy A. Andrzejak, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 1126 days.

(21) Appl. No.: 13/494,419

(22) Filed: Jun. 12, 2012

(65) Prior Publication Data

US 2013/0327571 A1 Dec. 12, 2013

(51) Int. Cl.
*F42B 1/036* (2006.01)
*F42B 1/032* (2006.01)

(52) U.S. Cl.
CPC ..... *F42B 1/036* (2013.01); *F42B 1/032* (2013.01); *Y10T 29/49* (2015.01)

(58) Field of Classification Search
CPC ..... F42B 1/36
See application file for complete search history.

(56) References Cited

U.S. PATENT DOCUMENTS 6,012,392 A † 1/2000 Norman
6,564,718 B2 5/2003 Reese et al.
7,278,353 B2 * 10/2007 Langan ..... F42B 1/032 102/306
7,547,345 B2 * 6/2009 Leidel ..... C22C 1/045 102/306
7,811,354 B2 † 10/2010 Leidel
2002/0185030 A1 12/2002 Reese et al.
2005/0241522 A1 * 11/2005 Stawovy ..... F42B 1/032 102/476
2009/0255433 A1 * 10/2009 Wang ..... E21B 43/117 102/307
2010/0275800 A1 11/2010 Stawovy
2013/0126238 A1 † 5/2013 Church

FOREIGN PATENT DOCUMENTS

EP 0538135 5/1997
WO W02011086365 7/2011
WO W02012013926 2/2012

OTHER PUBLICATIONS

International Search Report and Written Opinion dated Sep. 2, 2013 for International Patent Application No. PCT/US2013/044948, filed on Jun. 10, 2013, 13 pages.
Examination Report issued in related GB application GB1420871.4 dated Sep. 9, 2015, 2 pages.

* cited by examiner
† cited by third party

*Primary Examiner* — Aileen B Felton

(57) ABSTRACT

A shaped charge includes a casing, a liner disposed within an opening of the casing and an explosive disposed between the casing and the liner. The liner is made of a metal powder blend that includes a spheroidized metal powder. The spheroidized metal powder includes a spheroidized tungsten powder. The metal powder blend may further include a binder and a lubricant. The binder includes copper or lead. The lubricant includes graphite.

15 Claims, 6 Drawing Sheets

UTILIZATION OF SPHEROIDIZED TUNGSTEN IN SHAPED CHARGE SYSTEMS

FIELD

The invention generally relates to perforating tools used in downhole operations, and more particularly to apparatus and methods for improving perforation in a downhole.

BACKGROUND

After a well has been drilled and casing has been cemented in the well, one or more sections of the casing adjacent to formation zones may be perforated to allow fluids from the formation zones to flow into the well for production to the surface or to allow injection fluids to be applied into the formation zones. A perforating gun string may be lowered into the well to a desired depth, and the guns fired to create openings in the casing and to extend perforations into the surrounding formation.

Shaped charges are commonly used in perforating guns to create openings in the casing and channels in the formation zones. To yield best results for deep penetration, shaped charge liners may be made of pure metals due to their great density and ductility. However, liners made of pure metals may form slug that remains in the penetration channels. As a result, the penetrated hole can be plugged, which may interfere with the influx of production fluids, e.g., oil. To overcome this problem, liners used for downhole operations may be made of metal powders, such as pseudo-alloys. If unsintered, the liners may yield jets that are mainly composed of dispersed fine metal particles. To enhance penetration, powdered metal liners may contain high density metal powders, such as tungsten powders (mass density=19.3 $g/cm^3$), as major components.

U.S. Pat. No. 7,811,354, issued to Leidel et al., discloses the use, of a liner for a shaped charge having a high performance powdered metal mixture to achieve improved penetration depths during the perforation of a wellbore. This mixture includes powdered tungsten (92-99%), powdered metal binder (1-8%), and a lubricant, such as graphite, which can be compressively formed into a substantially conically shaped liner.

U.S. Pat. No. 6,564,718, issued to Reese et al., discloses a liner for a shaped charge formed from a mixture of powdered heavy metal and a powdered metal binder. The liner is formed by compression of the mixture into a liner body shape. The mixture contains a range of 90 to 97 percent by weight of powdered heavy metal, and 3 to 10 percent by weight of the powdered metal binder. Specifically, the preferred powdered heavy metal is tungsten, and the preferred powdered metal binder is copper. A lubricant, such as graphite powder or oil, can be intermixed with the powdered metal binder to aid in the formation of the shaped charge liner.

Although these approaches improve the performance of shaped charges, further improvements to methods for fabricating shaped charges that can achieve better penetration in downhole operations would be useful.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

One aspect relates to shaped charges. A shaped charge in accordance with one embodiment includes a casing; a liner disposed within an opening of the casing; and an explosive disposed between the casing and the liner. The liner is made of a metal powder blend that includes a spheroidized metal powder. The spheroidized metal powder includes a spheroidized tungsten powder. The metal powder blend may include a binder and a lubricant. The binder may include copper or lead. The lubricant may include zinc, tin, aluminum, nickel, antimony, cobalt, zinc alloys, tin alloys, aluminum alloys, or graphite.

Another embodiment relates to perforating guns. A perforating gun in accordance with one embodiment includes a shaped charge having a casing, a liner disposed within an opening of the casing, and an explosive disposed between the casing and the liner. The liner is made of a metal powder blend that includes a spheroidized metal powder. The spheroidized metal powder includes a spheroidized tungsten powder. The metal powder blend may include a binder and a lubricant. The binder may include copper or lead. The lubricant may include zinc, tin, aluminum, nickel, antimony, cobalt, zinc alloys, tin alloys, aluminum alloys, or graphite.

Another embodiment relates to methods for manufacturing shaped charges. A method in accordance with one embodiment includes obtaining a spheroidized tungsten powder and preparing a shaped charge. The shaped charge includes a casing, a liner disposed within an opening of the casing and an explosive disposed between the casing and the liner. The liner is made of a metal powder blend having a spheroidized metal powder. The spheroidized metal powder includes a spheroidized tungsten powder. The metal powder blend may further include a binder and a lubricant. The binder may include copper or lead. The lubricant may include zinc, tin, aluminum, nickel, antimony, cobalt, zinc alloys, tin alloys, aluminum alloys, or graphite.

Another embodiment relates to methods for perforating wells. A method in accordance with one embodiment includes positioning a perforating gun in the well and detonating the shaped charge in the well. The perforating gun includes a shaped charge that includes a casing, a liner disposed within an opening of the casing, and an explosive disposed between the casing and the liner. The liner is made of a metal powder blend having a spheroidized metal powder. The spheroidized metal powder includes a spheroidized tungsten powder. The metal powder blend may further include a binder and a lubricant. The binder may include copper or lead. The lubricant may include zinc, tin, aluminum, nickel, antimony, cobalt, zinc alloys, tin alloys, aluminum alloys, or graphite.

Other aspects and advantages of the invention will be apparent from the following description and the appended claims.

BRIEF DESCRIPTION OF DRAWINGS

Embodiments of utilization of spheroidized tungsten in shaped charge systems are described with reference to the following figures. The same numbers are used throughout the figures to reference like features and components.

DETAILED DESCRIPTION

Disclosed embodiments relate to, shaped charges and methods for fabricating and using the same. Specifically, embodiments relate to shaped charges having liners made of a material comprising spheroidized metal powders (e.g., tungsten powders) for improving fabrication of shaped charges and for improving their performance. For clarity of illustration, the following description may use spheroidized tungsten powders as examples. However, one skilled in the art would appreciate that this description is equally applicable to other spheroidized metal powders known in the art, such as spheroidized molybdenum powders, spheroidized niobium powders, spheroidized tantalum powders, and spheroidized rhenium powders, and a combination thereof. In addition, the following description uses examples having spheroidized metal powders incorporated into shaped charge liners. However, one skilled in the art would also appreciate that spheroidized metal powders may also be incorporated into casings, and a combination of casings and liners.

Figure 1:
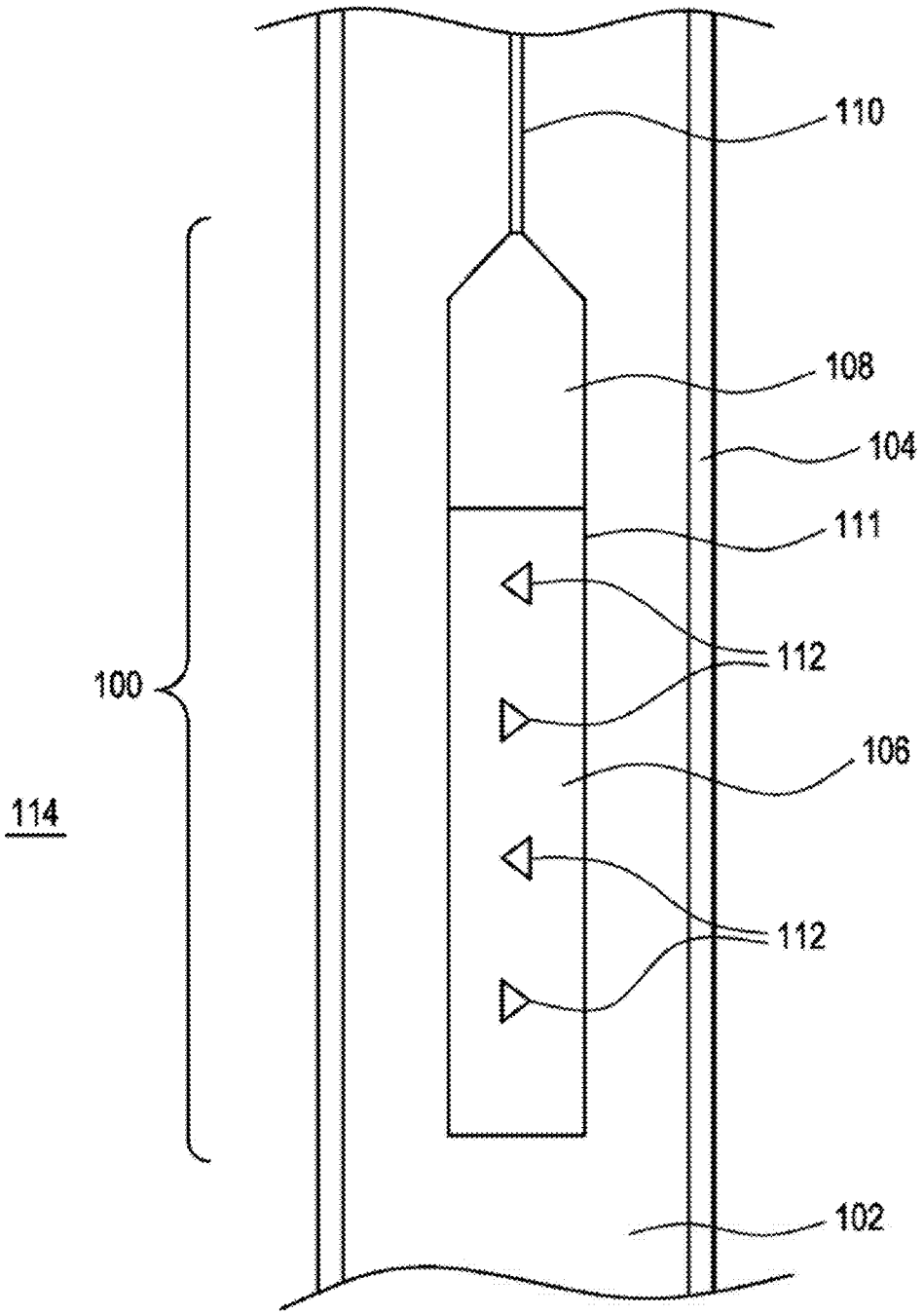
FIG. 1 (Prior Art)
FIG. 1 shows a known perforation device disposed in a well.

FIG. 1 illustrates an example tool string 100 that has been lowered into a wellbore 102, which is lined with casing 104. Tool string 100 includes a perforating gun 106 and other equipment 108, which may include a firing head, an anchor, a sensor module, a casing collar locator, and so forth, as examples. Tool string 100 is lowered into wellbore 102 on a carrier line 110, such as a tubing (e.g., a coiled tubing or other type of tubing), a wireline, and a slickline.

Perforating gun 106 has perforating charges that are in the form of shaped charges 112. Shaped charges 112 may be mounted on or otherwise carried by a carrier 111 of perforating gun 106, in which carrier 111 may be a carrier strip, a hollow carrier, or other type of carrier. Perforating gun 106 may be fired to create openings in casing 104 and to extend perforations into the surrounding formation 114.

Figure 2:
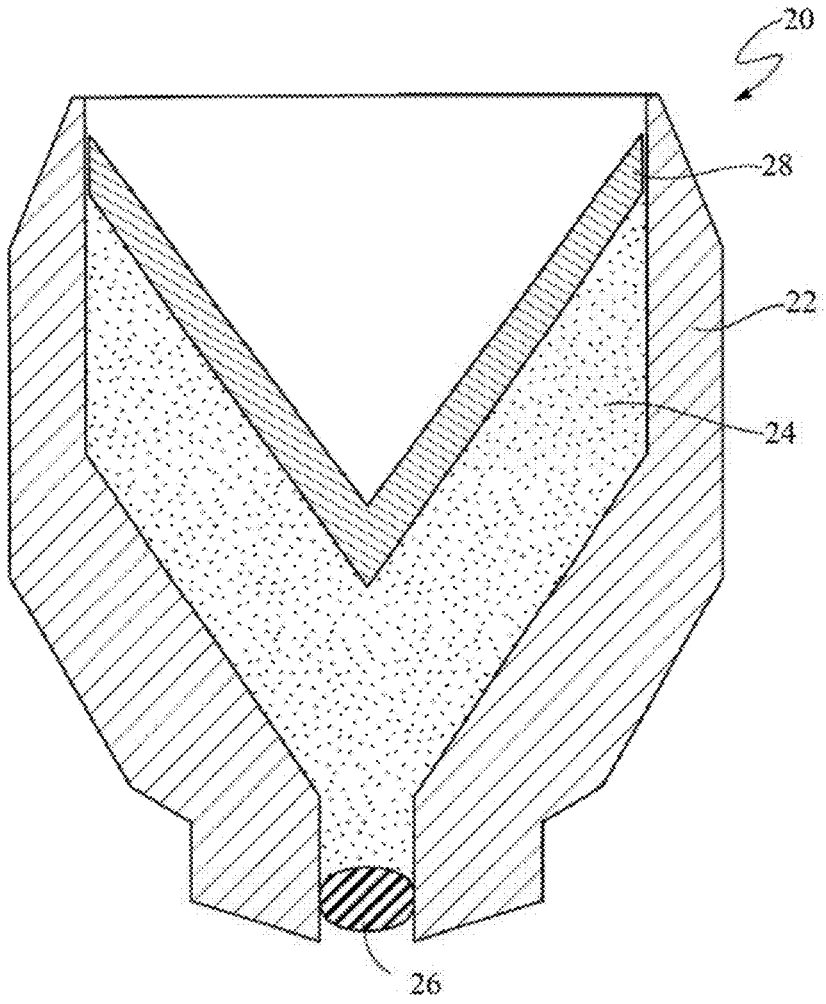
FIG. 2 (Prior Art)
FIG. 2 shows a cross-sectional layout of a known shaped charge.

FIG. 2 shows a known shaped charge 20. Shaped charge 20 may have a generally cylindrically shaped casing 22. Casing 22 may be formed from steel or other suitable material. High explosive powders 24, such as HMX (1,3,5,7-tetranitro-1,3,5,7-tetraazacyclooctane), HNS (hexanitrostilbene), RDX (hexahydro-1,3,5-trinitro-1,3,5-triazine), TATB (triaminotrinitrobenzene), PYX (2,6-bis picrylamino-3,5-dinitropyridine), NONA (2,2,2,4,4,4,6,6,6-nonanitroterphenyl), HNIW (2,4,6,8,10,12-hexanitro-2,4,6,8,10,12-hexaazaisowurtzitane), and TNAZ (1,3,3-Trinitroazetidine), may be disposed within casing 22. High explosive powders 24 may be detonated using a detonating signal provided by detonating cord 26 or other initiating device. Booster explosives (not shown) may be used between detonating cord 26 and high explosive powders 24 to efficiently transfer the detonating signal from detonating cord 26 to high explosive powders 24. Liner 28 is disposed in casing 22 so that high explosive 24 generally fills the volume between casing 22 and liner 28.

Liner 28 may be made of any suitable materials, including metals, graphite, and ceramic. Upon detonation of a shaped charge, the liner collapses and plastically deforms into a jet of material traveling at high speed to penetrate the target. Because the depth of penetration depends on the density of the penetration jet, the density in part dependent on the liner material, deep penetrations may be achieved by using liners containing dense metals, such as tungsten and lead.

Although pure solid metal liners may generally yield good results for deep penetration due to their higher density and ductility, the residue of the penetration jet may plug the newly created hole, thereby impeding influx of production fluid. In addition, adequate jet formation may not be achieved for pure solid metal liners owing to the lack of a stand-off between the charge and the gun wall and/or well casing. To overcome this problem, liner 28 may be formed by molding, under very high pressure, powdered metal mixture, into a conical shaped rigid body. In operation, when high explosive powders 24 is detonated using detonating cord 26, the force of the detonation collapses liner 28 causing liner 28 to be ejected in the form of a jet traveling at very high speed. These jets can penetrate casing, cement, and formation, thereby forming perforations.

As mentioned above, technology behind deep-penetrating shaped charges may rely on liners made of high density metal powders. Due to the high density associated with tungsten powders, deep penetration may be achieved by using tungsten powders or tungsten alloy as major components of shaped charge liners. Generally, the higher the tungsten content the deeper the penetration will be.

Figure 3:
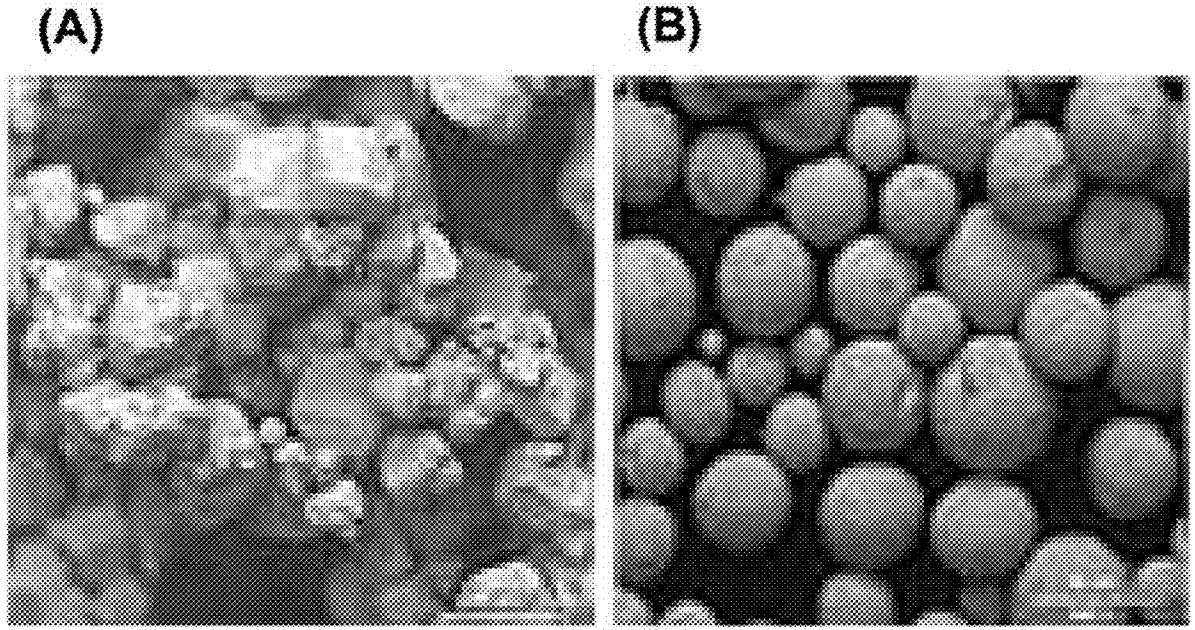
FIG. 3A shows a scanning electron microscope image of normal tungsten powders.
FIG. 3B shows a scanning electron microscope image of spheroidized tungsten powders.

Tungsten powders may be produced by chemically decomposing mineral or ore concentrates of tungsten to produce high purity tungsten or tungsten oxide. Tungsten oxide can be hydrogen-reduced to pure tungsten powders. These tungsten powders are referred to as "as-reduced, irregular tungsten powders" or "normal tungsten powders." Normal tungsten powders generally have polycrystalline structure, as shown in FIG. 3(A). The polycrystalline or irregular shape may be associated with abrasiveness of normal tungsten powders, which may cause tool wear during processing. In addition, the non-smooth surfaces of these particles or powders will have increased friction between the particles. As a result, liner powder blends containing normal tungsten powders may not have optimal flow characteristics. Lack of optimal flow characteristics may cause problems when fabricating shaped charge liners. Such problems may include variability in density profiles and inability to achieve maximal press densities.

To improve fabrication of shaped charges with tungsten powders, shaped charges can contain a form of tungsten, i.e., "spheroidized" or "spray densified" tungsten powders, which improves liner powder flow characteristics. For this purpose, other spheroidized metal powders may also be used, such as spheroidized molybdenum powders, spheroidized niobium powders, spheroidized tantalum powders, and spheroidized rhenium powders, and a combination thereof.

As used herein, the term "spheroidized" metal powders means metal powders having a spherical or substantially spherical shape, such as spheroidized tungsten powders shown in FIG. 3(B). For clarity, the description may use "powders" in a broad sense to include "particles." Specifically, in this description wherever "powder" is mentioned, one may substitute this with "particle" or use both "powder"

and "particle." In addition, the description may use the terms "irregular," "crystalline," and "polycrystalline," interchangeably to describe a non-spherical or non-substantially spherical shape. The term "normal tungsten powders" used herein is synonymous for the terms "as-reduced, irregular tungsten powders," "crystalline tungsten powders," or "polycrystalline tungsten powders."

Spheroidized tungsten powders may be made by any methods known in the art. The starting materials can include tungsten powders that have irregular or polycrystalline shapes. By entraining the irregular shaped particles of normal tungsten powders in an inert gas stream and passing the particles through a high temperature plasma gun or plasma flame ($T_{flame}$>4,000° C.), the irregular tungsten particles or powders ($T_{melting}$~3,700° C.) will be at least partially melted as they pass through the plasma gun to form molten droplets. These droplets may rapidly cool and solidify while in free-fall (as they exit the plasma gun), resulting in substantially spherical or spherical tungsten powders/particles that are amorphous (i.e., non-crystalline).

FIG. 3(B) shows an example of spheroidized tungsten powders having spherical or substantially spherical shapes. In accordance with some embodiments, spheroidized tungsten particles may be of any suitable sizes, such as about 1 mm, 100 μm or 50 μm, or any number in between, in average diameters. The particle sizes may be determined using any suitable instruments, such as the Microtrac M100 Particle Size Analyzer (Microtrac, Montgomeryville, Pa.) and the Malvern Mastersizer 2000/3000 (Malvern Instruments, Worcestershire, United Kingdom). Spheroidized tungsten powders are also commercially available, for example, from Global Tungsten & Powders (Towanda, Pa.) and Plasma Processes Incorporated (Huntsville, Ala.).

Spheroidized tungsten powders have a dramatically improved flowability and a higher bulk density. For example, Table 1 shows that both the flowability and bulk density of spheroidized tungsten powders (Spheroidized M65 Grade Tungsten) increase, as compared to those of normal tungsten (M65 Grade Tungsten). Specifically, the Hall flow rate of Spheroidized M65 Grade Tungsten powders is much higher and it takes 7 s for 50 g to flow, whereas there is no flow for M65 Grade Tungsten powders. Hall flow rate measures the ability of a powder to flow through a Hall funnel as described in ASTM Test Method B 213. The Hall flow rate is a function of inter-particle friction. As the friction increases, the Hall flow rate decreases. The spheroid shape greatly reduces the friction between the particles, thereby increasing the Hall flow rates of spheroidized tungsten particles.

In addition, the bulk density of Spheroidized M65 Grade Tungsten powders (9.76 g/cc) is higher than that of M65 Grade Tungsten powders (~5.5 g/cc). These improved features (both increased density and increased Hall flow rate) of spheroidized tungsten powders would dramatically improve manufacturability of these powders and the shaped charges made of this material would have improved performance. The improved manufacturability of these powders makes it easier to make shaped charges and less likely to cause tool wear. The high bulk density of this material will produce shaped charges with improved properties, such as increased penetration.

TABLE 1

| | M65 Grade Tungsten | Spheroidized M65 Grade Tungsten |
|---|---|---|
| Hall Flow | No Flow | 7 s for 50 g to flow |
| Bulk Density | ~5.5 g/cc | 9.76 g/cc |

Spheroidized tungsten powders would enhance the flowability of liner powder blends, which would result in improved malleability of spheroidized tungsten metal powder blends. The enhanced flowability characteristics of metal powder blends containing spheroidized tungsten powders may enable the fabrication of shaped charge liners or any parts of shaped charges with a high tungsten content, such as greater than 80%, 85%, 90%, 95%, or 99% by weight (wt %) of liners.

Embodiments include shaped charges having liners made of a metal powder blend comprising spheroidized tungsten powders, as well as shaped charges having liners that contain normal tungsten powders and spheroidized tungsten powders—i.e., regular tungsten powders may be completely or partially replaced with spheroidized tungsten powders.

Figure 4:
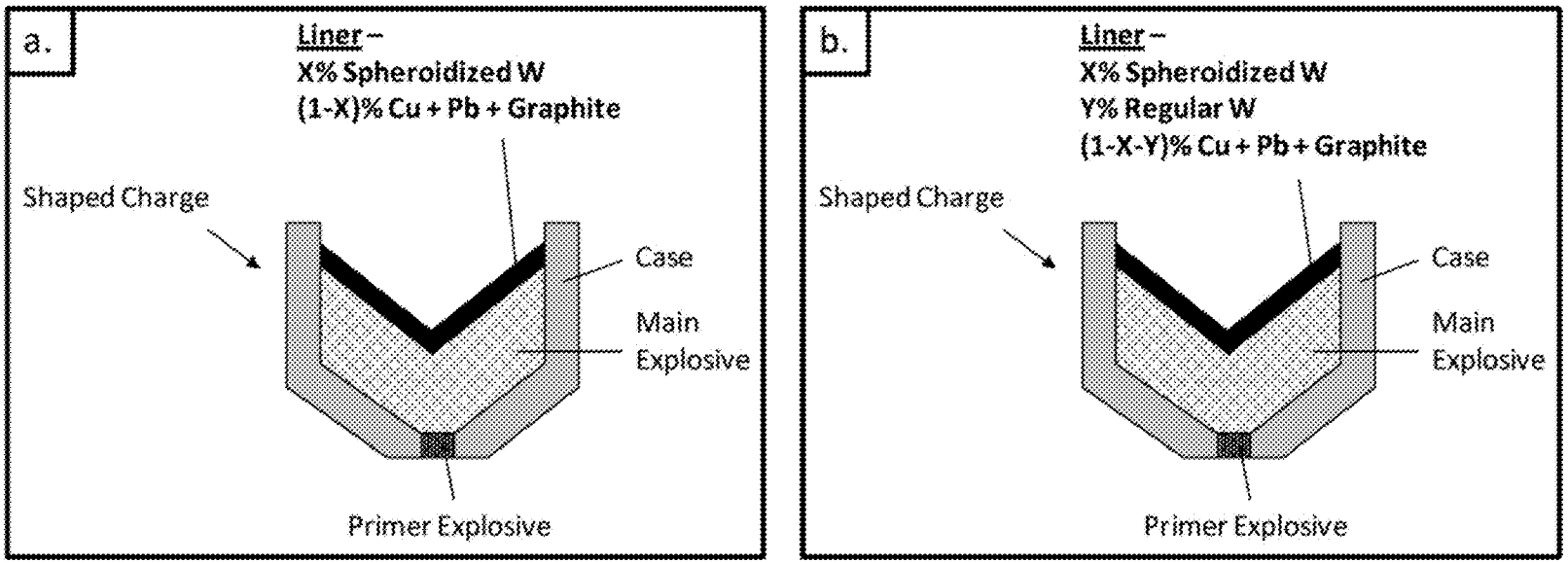
FIG. 4A shows a shaped charge comprising spheroidized tungsten powder in accordance with one embodiment.
FIG. 4B shows a shaped charge comprising spheroidized tungsten powder and regular tungsten powder in accordance with one embodiment.

FIG. 4*a* shows a schematic illustrating a cross-section view of a shaped charge in accordance with some embodiments that include spheroidized tungsten powders. As shown, liner may be made of a metal powder blend that includes X % (wt/wt) of spheroidized tungsten (W) powders/particle and (100−X) % of other components, which may include a metal binder (e.g., copper (Cu) and lead (Pb)) and a lubricant (e.g., graphite or oil or hydrocarbon). The liner may be made by pressing (with high pressure) such a metal powder blend into a conical shape. The liner may be made by other methods known in the art (e.g., sintering). Powdered metal binder may include other malleable ductile metals, such as tantalum, molybdenum, bismuth, zinc, tin, aluminum, nickel, silver, gold, antimony, cobalt, palladium, zinc alloys, tin alloys, or aluminum alloys, and combination thereof. Lubricants may include other hydrocarbons (e.g., wax, oil).

FIG. 4*b* shows another embodiment in accordance with some embodiments. Spheroidized tungsten powders/particles serve as replacement for part of normal tungsten powders in a metal powder blend for making a liner. For example, the liner may contain X wt % of spheroidized tungsten powders/particles and Y wt % of normal tungsten powders, the remaining portion may contain (100−X−Y) wt % of binder and lubricant, such as Cu+Pb+graphite (or oil). Again, powdered metal binder may contain other malleable ductile metals such as tantalum, molybdenum, bismuth, zinc, tin, aluminum, nickel, silver, gold, antimony, cobalt, palladium, zinc alloys, tin alloys, or aluminum alloys, and combination thereof. Lubricants may include other hydrocarbons (e.g., wax, oil).

Embodiments include shaped charges having spheroidized tungsten powders incorporated into liners and/or casing. Some embodiments relate to methods for manufacturing a shaped charge as described above.

Figure 5:
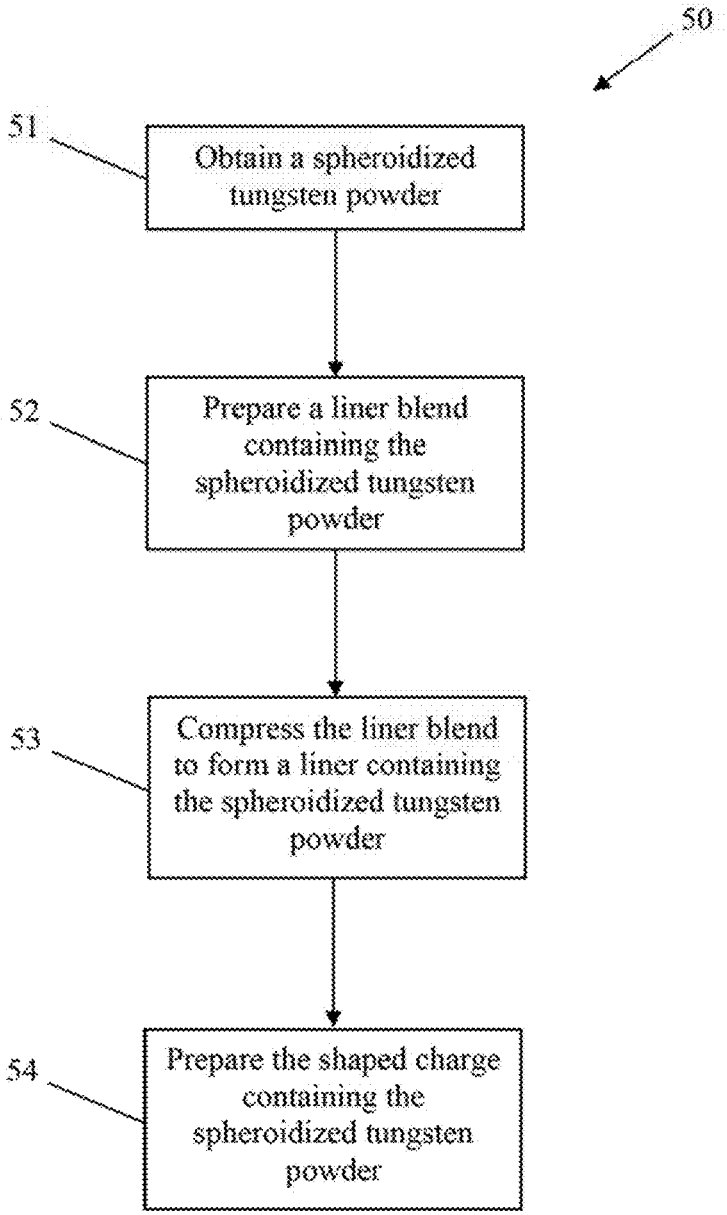
FIG. 5 shows a method for manufacturing a shaped charge in accordance with one embodiment.

FIG. 5 shows a method 50 in accordance with one embodiment. As shown, method 50 includes obtaining spheroidized tungsten powders (51). Then, one may prepare liner blends containing spheroidized tungsten powders in addition to other materials, such as Cu, Pb, graphite (or oil), and/or normal tungsten powders (52). For example, liner powder blends may contain spheroidized tungsten powders, Cu, Pb, and graphite. Liner blend may contain spheroidized tungsten powders, normal tungsten powders, Cu, Pb, and graphite. The liner powder blends containing spheroidized tungsten powders may be pressed into conical shapes configured to form shaped charge liners (53). Then, shaped charge liners containing spheroidized tungsten powders may be used to prepare shaped charges (54).

One skilled in the art would appreciate that the method 50 shown in FIG. 5 is for illustration only. Many variations and modifications to these procedures are possible without departing from the scope of the invention. For example, one may purchase a pre-made mixtures containing spheroidized tungsten powders from commercial sources. In this case, 51 and 52 would be combined to a single step.

Enhanced flowability of liner powder blends containing spheroidized tungsten powders may reduce the possibility of having batch-to-batch variation, which is sometimes observed in shaped charge liners made of normal tungsten powders. Reducing such a variation may improve the efficiency of producing shaped charges and minimize variability in shaped charge quality.

Due to high density of tungsten, it is particularly suitable for fabricating deep-penetrating shaped charges in downhole operations. The spheroidized tungsten particles further imparts desirable properties to this metal for use in shaped charges. For example, spheroidized tungsten powders in liners may improve both the transmission of detonation energy through liners and the manner by which liner particles feed into a shaped charge jet. Furthermore, the higher bulk density of the spheroidized tungsten powders may contribute to deeper penetration.

The performance of shaped charges with liners made of spheroidized tungsten powders have been examined. For example, the spheroidized tungsten powders are used to make PowerJet Omega 2906 charges. These shaped charges are found to have higher performance than regular shaped charges having normal tungsten powders. Tests have also been conducted that utilized design-of-experiment techniques to optimize the following parameters: percentage of spheroidized tungsten powder in liners and liner weight, among other parameters. The test results show that shaped charges with optimized parameters yield an average QC shot penetration of 34.5-inch using 28-g liners that contained 15% spheroidized tungsten. In contrast, shaped charges with normal tungsten powders in liners (similar to those used in current technology) yield an average of 30.5-inch penetration. In other words, there is 13% improvement in performance of shape charges having spheroidized tungsten powders over shaped charges used in current technology.

Figure 6:
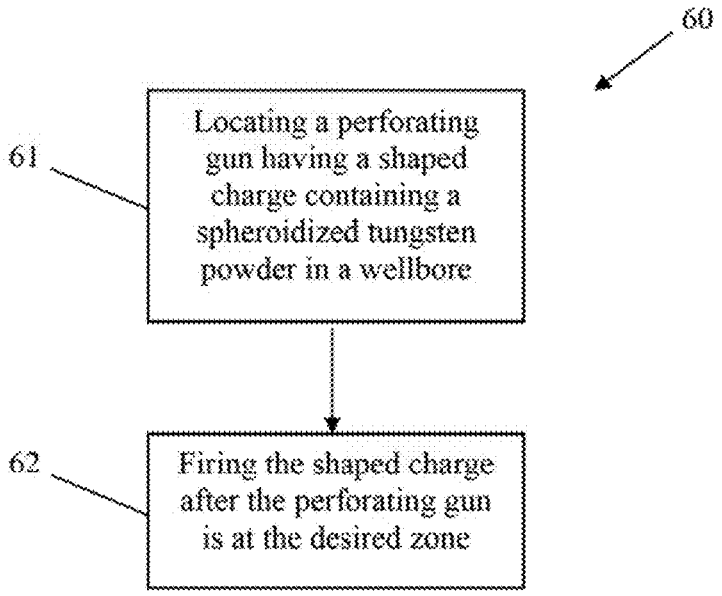
FIG. 6 shows a method for perforating a well in accordance with one embodiment.

Perforating devices, such as perforating guns, using shaped charges that contain spheroidized tungsten powders according to some embodiments may be used in perforating operations. For example, FIG. 6 shows a method 60 of perforating a formation in accordance with some embodiments. As shown, method 60 includes placing a perforating gun in a wellbore (61), in which the perforating gun may have one or more shaped charges that contain spheroidized tungsten powders in accordance with embodiments described above. Once the perforating gun is in the wellbore at the desired zone (depth), the shaped charge may be fired to create perforations in the well casing and/or nearby formation (62).

Advantages of embodiments may include one or more of the following. Spheroidized tungsten may have the potential to enhance shaped charge performance characteristics by improving both the transmission of detonation energy through the liner and the manner by which the liner particles feed into a shaped charge jet. The increased bulk density would also enhance the penetration. Thus, some embodiments can produce deeper-penetrating shaped charges by fully or partially substituting spheroidized tungsten for regular tungsten. The enhanced flowability also enables the production of liners that have an ultra-high tungsten content. Thus, some embodiments may have shaped charges with liners containing ultra-high content of tungsten, as in the next generation deep-penetrating shaped charges. The spheroidized tungsten would enable charge performance characteristics to be maintained with a lower overall tungsten content, which would permit a greater control of charge performance variability. Thus, some embodiments include shaped charges with liners containing less tungsten and yet maintaining the performance characteristics. The enhanced flowability of spheroidized tungsten results in less-abrasive liner powder blends, which would extend liner fabrication tool lives and reduce the variability in liner quality. The spheroidized tungsten may reduce the batch-to-batch variation of tungsten, which may be detrimental to shaped charge production efficiency and may impart variability to shaped charge quality. Thus, some embodiments would be easier to manufacture, and the reduced wear on tools and less variability may translate into lower costs of the shaped charges.

Although only a few example embodiments have been described in detail above, those skilled in the art will readily appreciate that many modifications are possible in the example embodiments without materially departing from utilization of spheroidized tungsten in shaped charge systems. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A shaped charge, comprising:

a casing comprising spheroidized metal powder;

a liner disposed within an opening of the casing; and an explosive disposed between the casing and the liner, wherein the liner is formed by pressing graphite and a metal powder blend that comprises a spheroidized metal powder into a conical shape.

2. The shaped charge of claim 1, wherein the spheroidized metal powder comprises a spheroidized tungsten powder.

3. The shaped charge of claim 2, wherein the metal powder blend further comprises one selected from the group consisting of copper, lead, zinc, tin, aluminum, nickel, antimony, cobalt, zinc alloys, tin alloys, aluminum alloys, and a combination thereof.

4. The shaped charge of claim 2, wherein the metal powder blend further comprises normal tungsten powder.

5. The shaped charge of claim 2, wherein the metal powder blend comprises greater than about 80 wt % of tungsten.

6. A method for manufacturing a shaped charge, comprising:

obtaining a spheroidized metal powder; and preparing a shaped charge comprising:

a casing comprising spheroidized metal powder;

a liner disposed within an opening of the casing; and an explosive disposed between the casing and the liner, wherein the liner is formed by pressing graphite and a metal powder blend that comprises a spheroidized metal powder into a conical shape.

7. The method of claim 6, wherein the spheroidized metal powder comprises a spheroidized tungsten powder.

8. The method of claim 7, wherein the metal powder blend further comprises one selected from the group consisting of copper, lead, zinc, tin, aluminum, nickel, antimony, cobalt, zinc alloys, tin alloys, aluminum alloys, graphite, and a combination thereof.

9. The method of claim 7, wherein the metal powder blend further comprises normal tungsten powder.

10. The method of claim 7, wherein the metal powder blend comprises greater than about 80 wt % of tungsten.

11. A method for perforating a well, comprising:

positioning a perforating gun in the well, wherein the perforating gun comprises a shaped charge that comprises: a casing comprising spheroidized metal powder, a liner disposed within an opening of the casing, and an explosive disposed between the casing and the liner, wherein the liner is formed by pressing graphite and a metal powder blend that comprises a spheroidized metal powder into a conical shape; and detonating the shaped charge in the well.

12. The method of claim 11, wherein the spheroidized metal powder comprises a spheroidized tungsten powder.

13. The method of claim 12, wherein the metal powder blend further comprises one selected from the group consisting of copper, lead, zinc, tin, aluminum, nickel, antimony, cobalt, zinc alloys, tin alloys, aluminum alloys, graphite, and a combination thereof.

14. The method of claim 12, wherein the metal powder blend further comprises normal tungsten powder.

15. The method of claim 12, wherein the metal powder blend comprises greater than about 80 wt % of tungsten.

* * * * *